United States Patent [19]

DiPaolo et al.

[11] Patent Number: 5,040,656

[45] Date of Patent: Aug. 20, 1991

[54] COIN-CONTROLLED APPARATUS FOR LOCKING SHOPPING CARTS TOGETHER

[76] Inventors: Anthony M. DiPaolo, 12379 Oak Hollow, Creve Coeur, Mo. 63141; John T. Hood, 1504 Avenue A, Webster Groves, Mo. 63119

[21] Appl. No.: 472,784

[22] Filed: Jan. 31, 1990

[51] Int. Cl.[5] ..... G07F 7/00; G07F 17/10

[52] U.S. Cl. ..... 194/212; 194/257; 194/905

[58] Field of Search ..... 194/905, 212, 257

[56] References Cited

U.S. PATENT DOCUMENTS

| | | | |
|---|---|---|---|
| 4,474,282 | 10/1984 | Lenander | 194/905 X |
| 4,502,584 | 3/1985 | Lambiris | 194/257 |
| 4,635,782 | 1/1987 | Wieth et al. | 194/212 |
| 4,637,507 | 1/1987 | Ricouard et al. | 194/905 X |
| 4,691,816 | 9/1987 | Trubiano | 194/905 X |
| 4,766,989 | 8/1988 | Maloeuvre et al. | 194/905 X |
| 4,924,994 | 5/1990 | Pinsson et al. | 194/905 X |

*Primary Examiner*—Frank E. Werner
*Assistant Examiner*—Brian K. Dinicola
*Attorney, Agent, or Firm*—Senniger, Powers, Leavitt & Roedel

[57] ABSTRACT

Coin-controlled apparatus for locking shopping carts together in nested series at a cart parking station having a coin-controlled mechanism mounted on a cart, e.g. on the handle of the cart, which is adapted for receiving and releasably locking therein a latch bar on a tether which is attached to the next cart in the nested series, requiring deposit of a coin to release the latch bar to free the cart for being wheeled away by the user, and holding the coin until the user brings the cart back to a cart parking station, nests it in the end cart at the parking station, and inserts the latch bar which is tethered to said end cart in the mechanism to lock the returned cart to the series and to provide for return of the user's coin.

1 Claim, 4 Drawing Sheets

COIN-CONTROLLED APPARATUS FOR LOCKING SHOPPING CARTS TOGETHER

BACKGROUND OF THE INVENTION

This invention relates to coin-controlled apparatus for locking shopping carts together, and more particularly for locking such carts together in nested series at a cart parking station, such as a cart parking station on a parking lot of a supermarket or other establishment in which shopping carts are used.

The invention is especially concerned with a coin-controlled mechanism of such apparatus which is mounted on a shopping cart, e.g. on the handle of the cart, and which is adapted for receiving and releasably locking therein a latch bar on a tether which i: attached to the next cart in the nested series, requiring deposit of a coin to release the latch bar to free the cart for being wheeled away by the user, and holding the coin until the user brings the cart back to a cart parking station, nests it in the end cart at the parking station, and inserts the latch bar which is tethered to said end cart in the mechanism to lock the returned cart to the series and to provide for return of the user's coin.

The invention is in the same field as the "Safety Arrangement" disclosed in U.S. Pat. No. 4,635,782 issued Jan. 13, 1987, among its several objects being the provision of improved and simplified coin-controlled mechanism for the stated purpose, more particularly the provision of such mechanism which is more economical to manufacture by reason of being of simplified and more economical construction which is more easily and more economically assembled; and the provision of such mechanism which is more weatherproof, e.g. less likely to have water accumulate therein (as from rain) or freeze up, the basic object being to diminish the labor involved in handling the carts and to obtain longer useful life for the carts.

In general a coin-controlled apparatus of this invention for locking shopping carts together in nested series comprises coin-controlled mechanism which is mounted on a cart and which is adapted for receiving and releasably locking therein a bar on a tether attached to the next cart in the series. Said coin-controlled mechanism comprises an elongate body having a top, bottom, sides and rearward and forward ends, with an elongate slideway for a coin slide extending therein from the rearward end thereof toward the forward end, said body being adapted for being mounted in a generally horizontal position on a shopping cart. A coin slide is slidable in the slideway and has a forward and a rearward portion. A detent for the coin slide is pivoted in a recess in the top of the body and is biased downwardly into engagement with the top of the slide. The top of the slide has a first stop engageable with the detent to determine a rearward position of the slide wherein its rearward portion extends out rearward of the body and a second stop spaced from the rearward stop engageable with the detent to determine a forward position of the slide, the slide being biased by spring means toward its rearward position. The rearward portion of the slide has a relatively deep narrow recess for holding a coin on edge therein with the coin projecting up out of the recess, the recess being located outwardly of the rearward end of the body when the slide is in its rearward position for deposit of a coin in the recess and retrieval of a coin from the recess and being located within the body when the slide is pushed inward and forward to its said forward position. The upper portion of a coin in the recess is engageable with the detent when the slide is pushed inward and forward in the body to raise the detent to allow the slide to be pushed into a forward position forward of the limit imposed by said second stop. The body has a first hole in one side thereof and a housing on the opposite side with a recess in the housing and a second hole transversely aligned with the first hole extending between the slideway and the recess in said housing. A latch for the slide is slidable in said recess in said side housing and in said second hole between a laterally retracted position clear of the slideway and a slide-latching position extending into and across the slideway, and biased by spring means in &he recess in said side housing toward its said slide-latching position. The inner portion of the slide has a side-to-side elongate slot therein and a tongue for locking the bar in the body extending from the forward end of the slot toward but terminating short of the rearward end of the slot to provide a space for passage of the bar therethrough, the bar having a side-to-side hole therein for reception of the locking tongue on sliding out of the slide from its forward to its rearward position. The latch for the slide is movable under its bias to its slide-latching position when the slide is pushed in to its forward position, and when in its slide-latching position extends into said space in the slide and is engageable by the tip of the tongue to latch the slide in its forward position to hold the coin in the slide within the body. The latch is pushed back by the bar on insertion of the bar in the first hole and pushing in the bar to release the slide and allow it to move rearward under its bias to its rearward position for entry of the tongue in the hole in the bar for locking the bar in the body and for returning the coin in the slide. Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION

Figure 1:
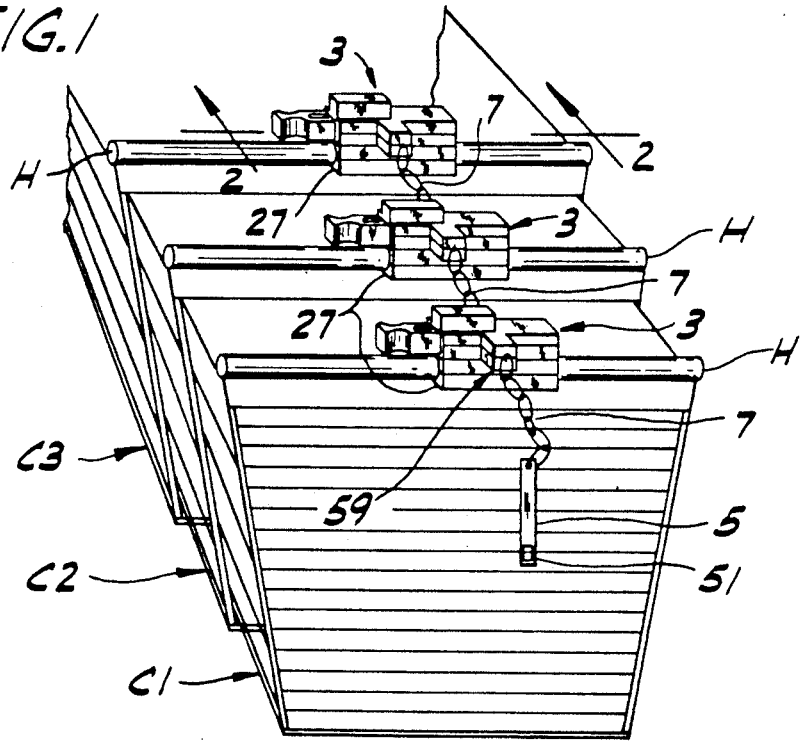
FIG. 1 is a generally perspective view showing a series of nested shopping carts locked together by a coin-controlled apparatus of this invention, the cart wheels being omitted.

Referring first to FIG. 1 of the drawings, there is shown a series of shopping carts disposed in nested relation as at a cart parking station in the parking lot of a supermarket. Three such carts are shown, designated C1, C2 and C3, C1 being the end cart of the series nested in C2, and C2 being nested in C3. The handle of each cart is designated H; the cart wheels are omitted. At 1 is generally indicated the coin-controlled apparatus of this invention for locking the carts together in the nested series, this apparatus comprising a coin-controlled mechanism designated in its entirety by the reference numeral 3 mounted on each cart, more particularly on the handle of the cart, each mechanism being adapted for receiving and releasably locking therein (under coin control) a latch bar 5 on a tether 7, preferably a chain, which is attached to the next cart (more particularly attached to the coin-controlled mechanism 3 on the next cart in the series). As illustrated in FIG. 1, cart C1 is locked to cart C2 by the latch bar 5 on the chain 7 extending from the mechanism 3 on cart C2 and cart C2 is locked to cart C3 by the latch bar 5 on the chain 7 extending from the mechanism 3 on cart C3. The chain 7 which is secured to the mechanism 3 on cart C1 is shown as hanging loose, awaiting insertion of the latch bar 5 on that chain in the mechanism 3 on the next cart which is wheeled up to be nested in cart C1.

Each coin mechanism 3 comprises an elongate body generally designated 9 having a top 11, bottom 13, sides 15 and 17 and ends 19 and 21, end 19 being referred to as the rearward end and end 21 being referred to as the forward end. The body is made to have an elongate opening 23 therein extending from its rearward end 19, where it is open, toward but terminating short of its forward end 21, where it is closed. This opening 23, which is of rectangular shape in transverse section constitutes a slideway for a coin slide 25 which extends slidably therein from the rearward end 19 of the body toward the forward end 21. The body 9 is adapted for being mounted in a generally horizontal position on a shopping cart, more particularly in such position above the handle H of the cart extending lengthwise of the handle by having mounting means such as generally indicated at 27 on the bottom thereof.

The elongate body 3 is of two-part construction comprising a lower part 29 (see FIGS. 10–13) generally of channel shape in cross section having an elongate bottom wall or web 31 (the bottom of which is the bottom 13 of the body), upwardly extending side walls 33 and 35 and a forward end wall 37, and an upper part 39 (see FIGS. 6–9) generally of inverted channel shape in cross section having an elongate upper wall 41 (the top of which is the top 11 of the body), downwardly extending side walls 43 and 45 and a forward end wall 47. All these walls have a height one-half the full body height. The two parts are assembled with the downwardly extending side walls of the upper part extending on the upwardly extending side walls of the lower Part, and with the forward end wall of the upper part mating with the forward end wall of the lower part, the two parts being secured together as by screw: as indicated at 49 in FIG. 5A. The slideway 23 is defined in the body 9 by the bottom wall 31 and side walls 33 and 35 of the lower part and the side walls 43 and 45 and top wall 41 of the upper part, the slide 25 generally being of rectangular cross section corresponding generally to the rectangular cross section of the slideway and having a relatively close sliding fit therein.

The latch bar 5 is a relatively thin flat elongate bar of rectangular cross section e.g. five inches long, 9/16 inch wide and ¼ inch thick, having a rectangular hole 51 therein adjacent one end thereof, which may be referred to as its inner end, extending through the bar from one broad side thereof to the other. The body 9 is formed in its side 15 (constituted by walls 33 and 35 of parts 29 and 39), which is the side of the body which faces forward relative to the cart as the mechanism 3 is mounted on the handle of the cart, with a hole 53 for insertion of the latch bar. This hole is formed by a slot 55 in the upwardly extending side wall 33 of the lower part 29 of the body and an aligned slot 57 in the downwardly extending side wall 43 of the upper part 39 of the body, each slot forming half the hole. The body is also formed with a housing generally designated 59 on the side opposite the hole 53 extending laterally outwardly therefrom with a recess 61 in this housing and a second hole 63 transversely aligned with the hole 53 extendng between the slidewall 23 and the recess 61 in said side housing 59. The latter comprises a lower part 65 on the outside of the lower part 29 of the body and an upper part 67 on the outside of the upper part 39 of the body. The lower part 65 has a bottom 69, and upwardly extending side walls 71 and 73 and an end wall 75, and the upper part 67 has a top 77, downwardly extending side walls 79 and 81 and an end wall 83, these walls all having a height one-half the body height and registering to form the housing 59 with the recess 61 therein. The hole 63 is narrower than the recess 61 and is located centrally at the end of the recess toward the slideway 23, defining shoulders 85 at the end of the recess toward the slideway 23. It is formed by a slot 87 in the upwardly extending side wall 35 of the lower part 29 of the body 9 and an aligned slot 89 in the downwardly extending side wall 45 of the upper part 39 of the body. End walls 75 and 83 meet to form a closed outer end for the housing 59.

Figure 2:
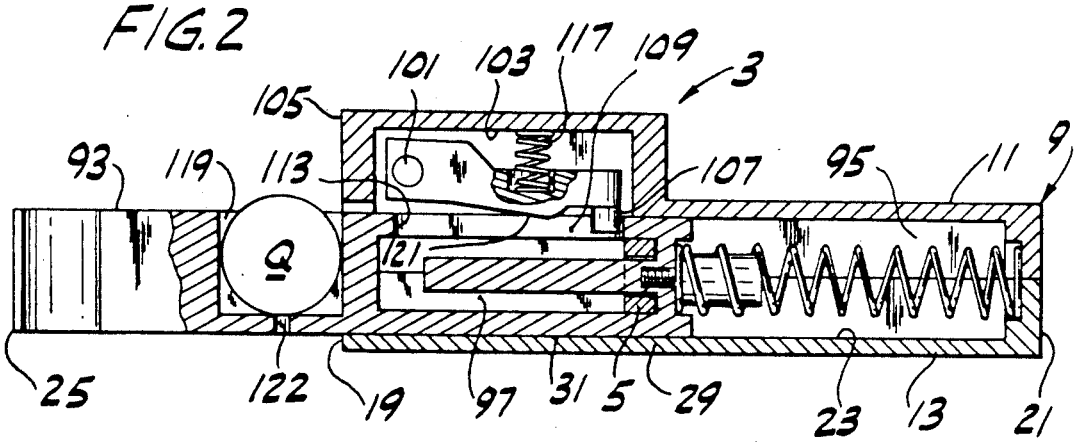
FIG. 2 is vertical longitudinal section of a coin-controlled mechanism of the apparatus, generally on line 2—2 of FIG. 1, showing the coin slide of the mechanism in a rearward position (its outer or retracted position) with respect to the body of the mechanism, in which it is slidable.

The coin slide 25 has a forward (inner) portion indicated at 91 and a rearward (outer) portion 93, "forward" being in reference to the direction in which the slide is pushed in, and "rearward" being the reverse. A coil compression spring 95 accommodated in the slideway 23 toward its forward end acts from the closed end of the slideway at 21 against the forward end of the slide 25 to bias it rearward. The inner portion of the coin slide has an elongate slot 97 extending lengthwise thereof and extending therethrough from one side to the other. A detent 99 for the coin slide is pivoted by a pin 101 in a recess 103 in an auxiliary housing 105 on top of the body 9 adjacent the rearward end of the body. This detent has a Pin 107 adjacent its free (forward) end which, when the detent is down, extends into an elongate ;lot 109 in the top of the forward portion 91 of the slide extending lengthwise thereof. The forward end 111 of this slot 109 constitutes a first stop engageable with the pin 107 of the detent to limit the rearward movement of the slide under the bias of the spring 95 to determine a rearward (outer) position of the slide (see FIG. 2). The rearward end 113 of the slot 109 constitutes a second stop engageable with the pin of the detent to prevent the slide from being pushed all the way in to its full forward (inner) position shown in FIGS. 4 and 5. The detent is biased downwardly toward the top of the slide by a coil compression spring 117 in the housing 105.

Figure 3:
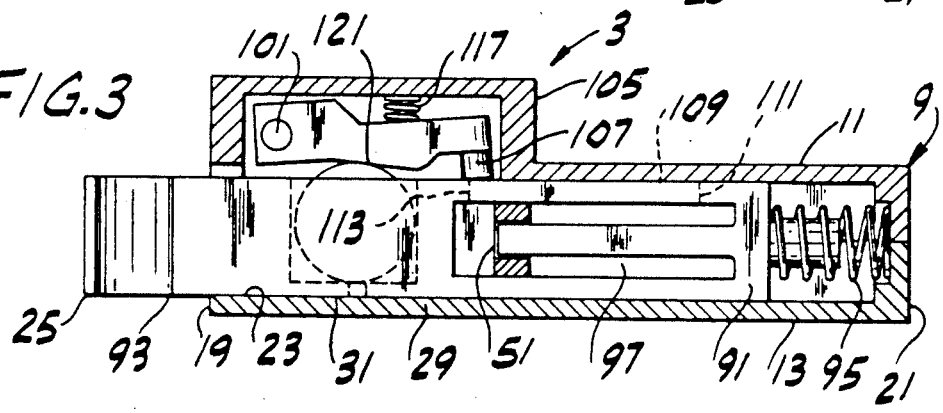
FIG. 3 is a view similar to FIG. 2 showing the coin slide in an intermediate position.
Figure 4:
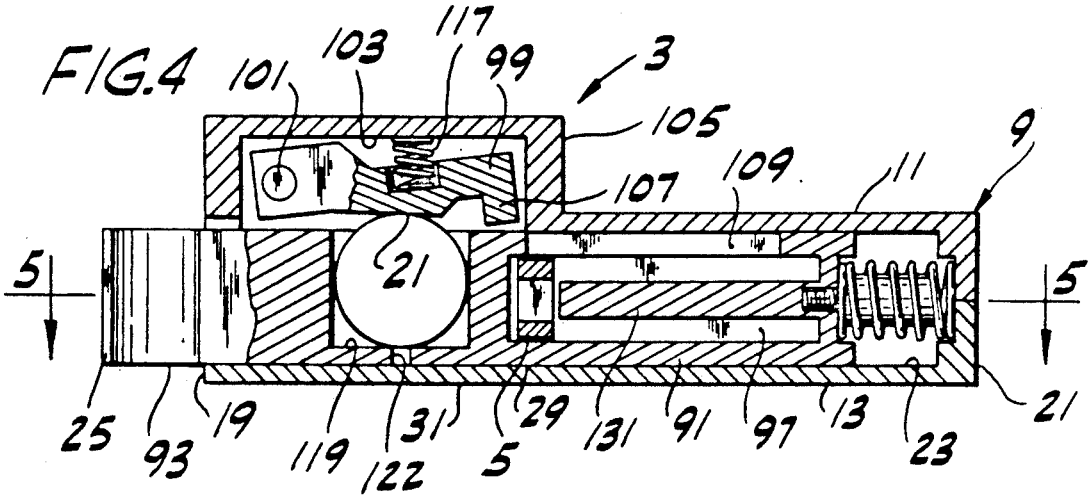
FIG. 4 is a view similar to FIGS. 2 and 3 showing the coin slide in its forward (inner) position.

The rearward portion 93 of the slide 25 has a relatively deep narrow recess or pocket 119 for holding a coin, more particularly a U. S. quarter Q, on edge therein with the coin projecting up out of the recess as appears in FIGS. 2-4. The recess 119 is located outwardly of the rearward end of the body 9 when the slide is in its rearward position of FIG. 2 for deposit or insertion of a coin in the recess and for retrieval of a coin from the recess, and is located within the body when the slide is pushed inward and forward to its stated forward position, i.e. the position in which it is shown in FIGS. 4 and 5. The detent has a lower cam surface as indicated at 121 engageable with the top of the slide 25 as appears in FIG. 2 and with which the upper portion of the coin in the recess is engageable when the slide is pushed inward and forward in the body to raise the detent and thereby raise the pin 107 out of the slot 109 to allow the slide to be pushed all the way in to its said forward position. The recess 119 has a drain hole 122 to avoid collection of rainwater therein.

Figure 5A:
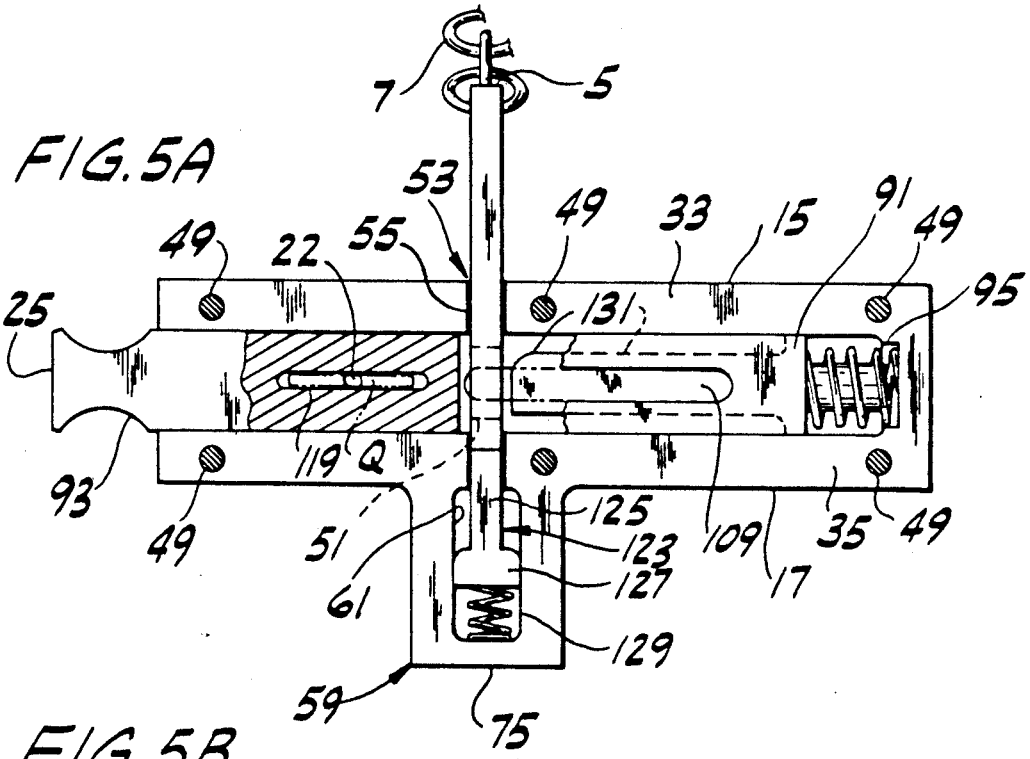
FIG. 5A is a horizontal longitudinal section generally on line 5—5 of FIG. 4 showing a latch bar of the apparatus in position extending across the slideway in the body of the mechanism just before it is pushed out by the slide latch of the apparatus.
Figure 5B:
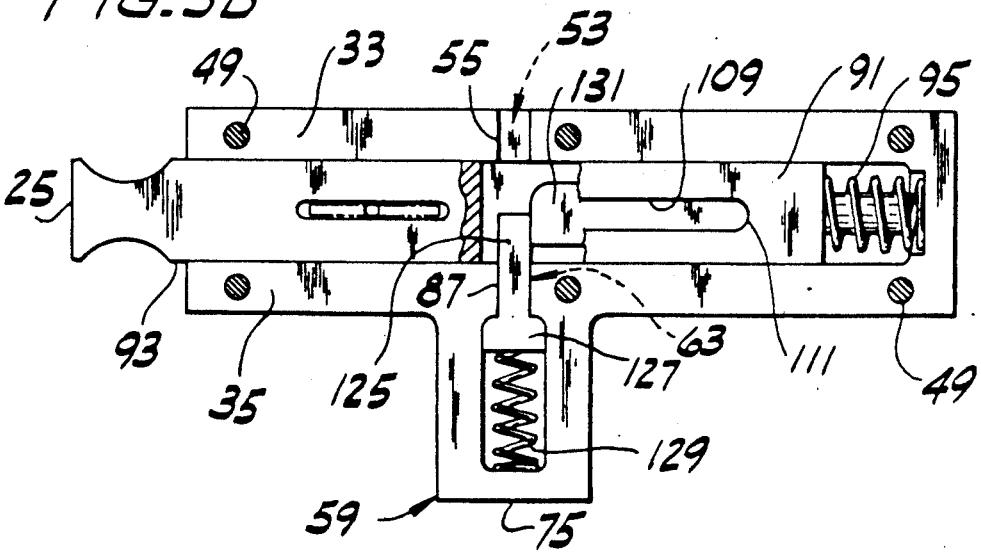
FIG. 5B is a view similar to FIG. 5A showing the slide latch in its slide-latching position, having pushed out the latch bar.
Figure 6:
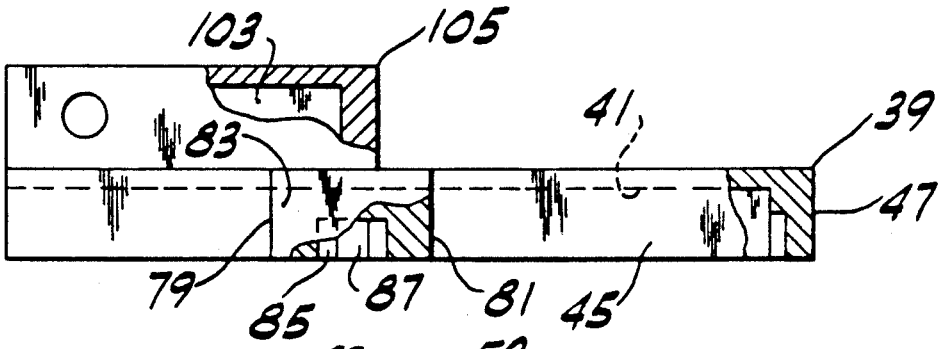
FIG. 6 is a view in elevation of one side of the upper part of the body of the mechanism, with parts broken away and shown in section.
Figure 7:
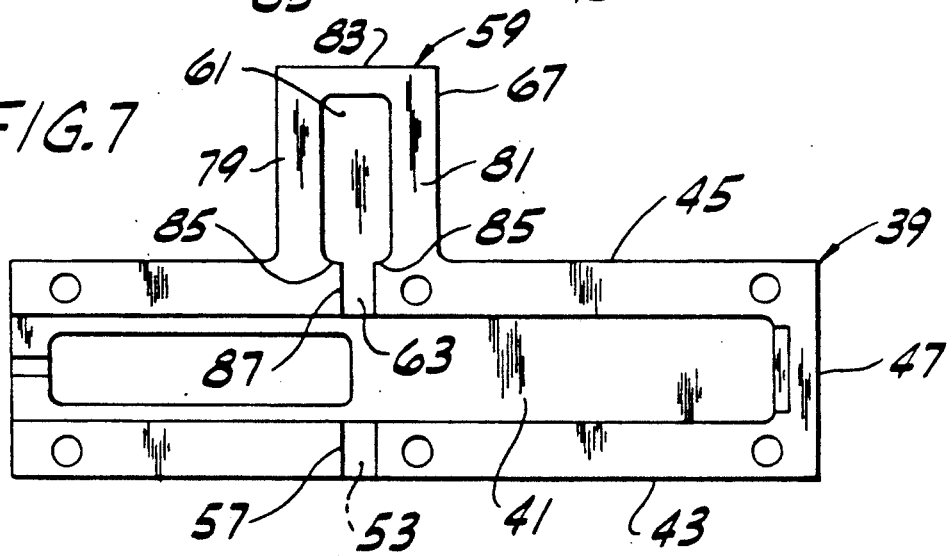
FIG. 7 is a bottom plan of the upper part.
Figure 8:
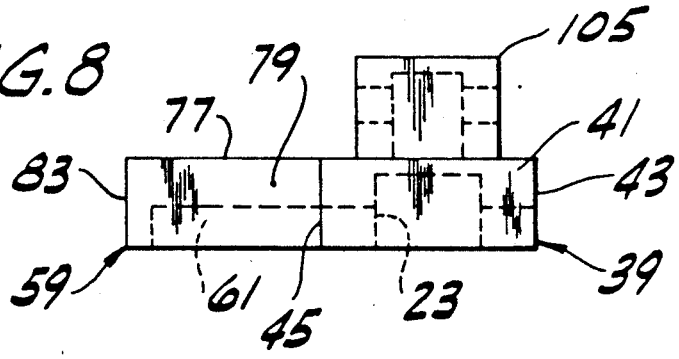
FIG. 8 is a view of the upper part from its left end.
Figure 9:
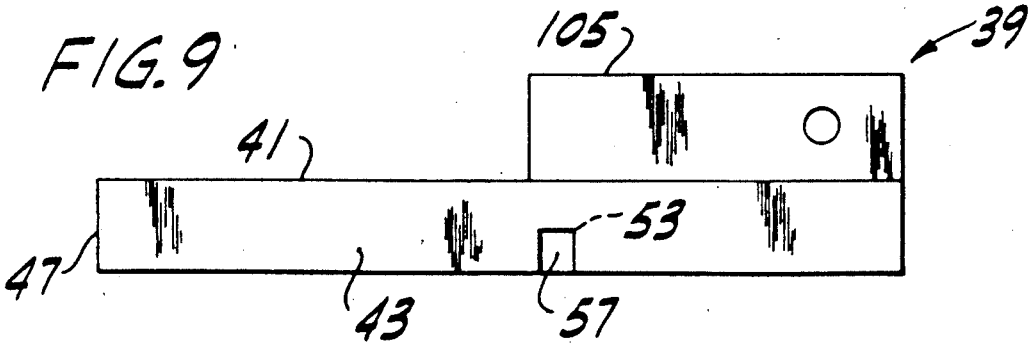
FIG. 9 is a view in elevation of the other side of the upper part.
Figure 10:
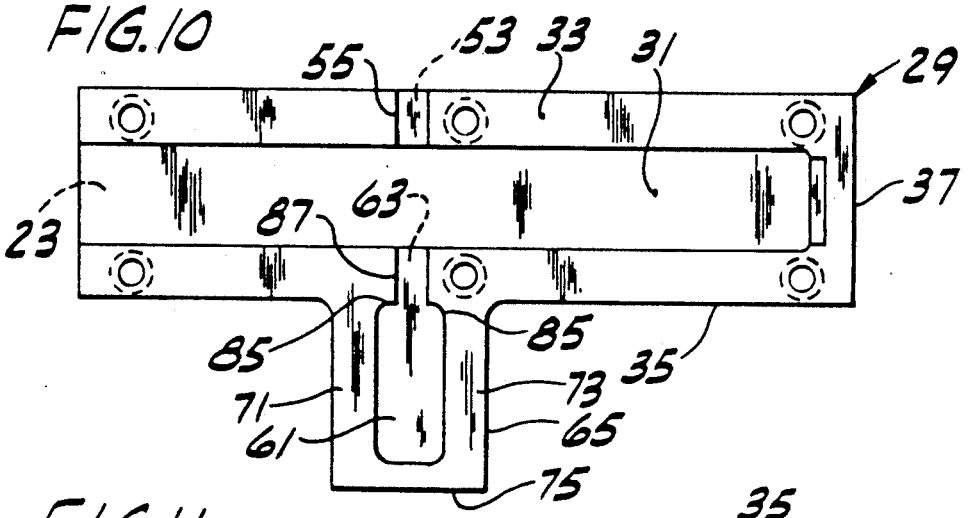
FIG. 10 is a plan of the lower part of the body.
Figure 11:
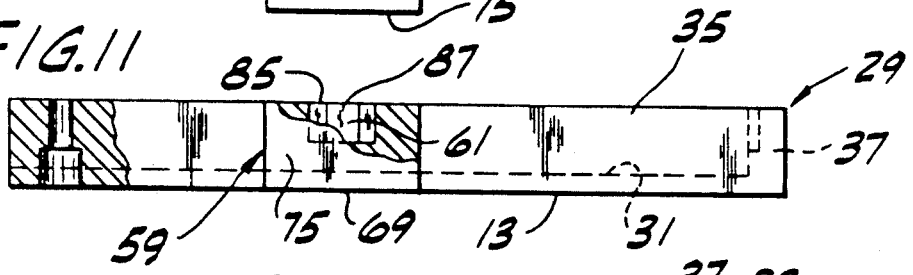
FIG. 11 is a view in elevation of one side of the lower part.
Figure 12:
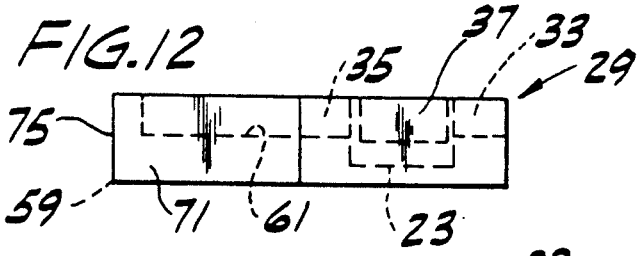
FIG. 12 is a view of the lower part from its right end.
Figure 13:
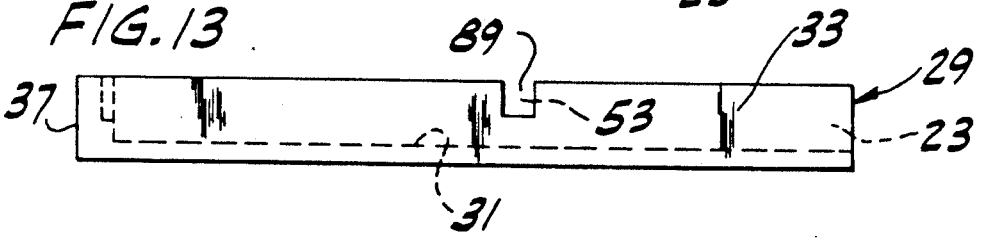
FIG. 13 is a view in elevation of the other side of the lower part.
Figure 14:
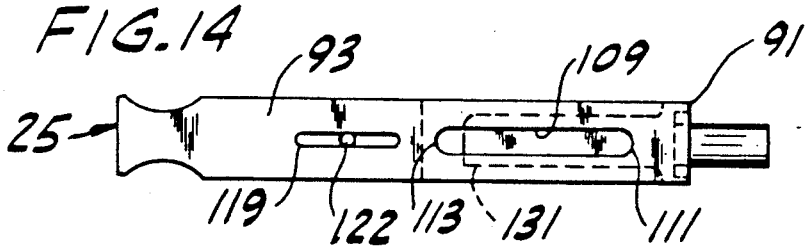
FIG. 14 is a plan of the coin slide per se.
Figure 15:
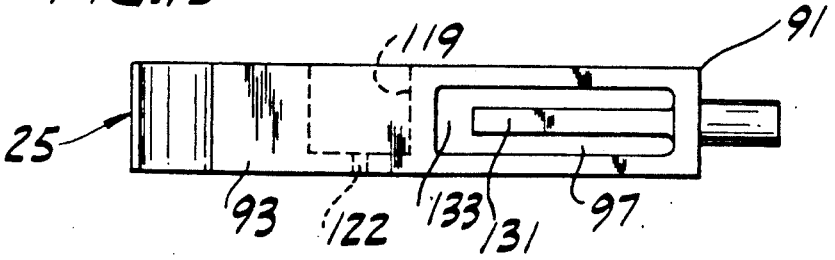
FIG. 15 is a view in elevation of one side of the coin slide.

At 123 is indicated a latch for latching the slide 25 in its said forward position to hold a coin in the recess against retrieval as will appear This latch is slidable in the recess 61 in the lateral or side housing 59 on the body 9 and in the hole 53, being of T-shape in plan having a stem 125 slidable in the hole 53 and a head 127 slidable in the recess 61, between a laterally retracted position clear of the slideway 23 wherein the stem 125 is back in the hole 53 (see FIG. 5A) and a slide-latching position wherein the stem 125 extends into and across the slideway 23 (see FIG. 5B). The latch 123 is biased by a coil compression spring 129 accommodated in the recess 61 between the outer end of the recess and the head 127 toward its slide-latching position. A tongue 131 for entry in the hole 51 in the latch bar 5 for locking the latch bar in the body 9 extends rearward from the forward end of the slot 97 in the slide 27 toward but terminating short of the rearward end of the slot to provide a space indicated at 133 for passage of the latch bar therethrough.

Each coin mechanism 3 has the respective latch bar chain 7 suitably attached securely at the other end of the chain from the latch bar 5 to the outer end of the lateral housing 59 of the mechanism. The coin mechanism is mounted on the handle of the cart with the housing 59 extending rearward with respect to the cart; thus as to the cart C1 as shown in FIG. 1, the chain 7 with the latch bar 5 thereon hangs down at the rear end cf the cart in position where it is readily accessible to the user. Also as shown in FIG. 1, the coin slides 25 of the mechanisms on each of the three carts are in their rearward (outer) positions wherein the coin recesses 119 therein are accessible for dropping in a coin. The latch bar 5 on the chain 7 attached to cart C2 is locked in the mechanism C3 on cart C1, and the latch 5 on the chain 7 attached to cart C3 is locked in the mechanism on cart C2. Locking of the latch bars in the mechanism on carts C1 and C2 results from the tongues 131 of the coin slides 25 of these mechanisms extending through the holes 51 in the latch bars 5, thereby pinning the latch bars in the bodies 9 of the respective mechanisms.

To free cart C1 for being wheeled into the supermarket (or other establishment), the user drops a coin (a U. S. quarter Q as herein described) into the recess 119 in the rearward (outer) portion 93 of the coin slide 25 of the mechanism 3 on cart C1 and pushes the slide in all the way to its stated forward position, i.e. the position in which it is shown in FIGS. 4 and 5A. This is enabled by reason of the upper portion of the coin camming the detent 99 upward so that pin 107 clears the stop 113. When the slide is pushed in to its forward position, the tongue 131 is withdrawn from the hole 51 in the latch bar 5 on chain 7 which extends from cart C2 thereby unlocking the latch bar and freeing it for removal from the body of the mechanism on cart C1. Under the bias of spring 129 the slide latch 123 pushes the latch bar 5 in the direction for removal from the body 9 and moves into the space 133 between the rearward end of the tongue 131 and the rearward end of the slot 97; thereby assuming a slide-locking position wherein it is engaged by the tip of the tongue to lock the slide 25 in its said forward (inner) position and thereby hold the coin which is in the recess 119 inaccessible within the body. The user is enabled to obtain return of the coin, however, by returning the cart to the parking station where it was obtained, (or another parking station) and inserting the latch bar 5 on the chain extending from the end cart of the series at the station into the hole 13 and pushing it in against the slide latch 123 and through the space 133, thereby retracting the slide latch 123 to enable the slide 25 to be pushed forward by the spring 95, and the tongue 131 to pass through the hole 51 in the latch bar 5 to lock the returned cart to the series of carts.

The mounting means 27 for the body 9 may be of any suitable construction for mounting the body in a generally horizontal position on top of the handle H of a cart C. Thus, it may comprise an upper part which is secured to the bottom of the body by the screws 49, having a groove generally of semi-circular cross-section extending lengthwise thereof for fitting on the handle, and a lower mating part attached to the upper part by tamper-proof screws, the two parts acting as a clamp for clanging the body on the handle.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

WHAT IS CLAIMED IS:

1. The Coin-controlled apparatus for locking shopping carts together in nested series comprising coin-controlled mechanism which is mounted on a cart and which is adapted for receiving and releasably locking therein a bar on a tether attached to the next cart in the series; said mechanism comprising:

an elongate body having a top, bottom, sides and rearward and forward ends, with an elongate slideway for a coin slide extending therein from the rearward end thereof toward the forward end, said body being adapted for being mounted in a generally horizontal position on a shopping cart;

a coins slide slidable in the slideway having a forward and a rearward portion;

a dentent for the coin slide pivoted in a recess in the top of the body biased downwardly into engagement with the top of the slide;

the top of the slide having a first stop engageable with the dentent to determine an outer rearward position of the slide wherein its rearward portion extends out rearward of the body and a second stop spaced from the rearward stop engageable with the detent to limit forward movement of the slide.

spring means biasing the slide toward its rearward position;

the rearward portion of the slide having a relatively deep narrow recess for holding a coin on edge therein with the coin projecting up out of the recess, the recess being located outwardly of the rearward end of the body when the slide is in its rearward position for deposit of a coin in the recess and retrieval of a coin from the recess and being located within the body when the slide is pushed inward and forward to its said forward position;

the upper portion of a coin in the recess being engageable with the detent when the slide is pushed inward and forward in the body to raise the detent to allow the slide to be pushed in to a forward position forward of the limit imposed by said second stop;

the body having a first hole in one side thereof and a housing on the opposite side with a recess in the housing and a second hole transversely aligned with the first hole extending between the slideway and the recess in said side housing;

a latch for the slide slidable in said recess in said side housing and in said second hole between a laterally retracted position clear of the slideway and a slide-latching position extending into and across the slideway, and biased by spring means in the recess in said side housing toward its said slide-latching position;

the inner portion of the slide having a side-to-side elongate slot therein and a tongue for locking the bar in the body extending from the forward end of the slot toward but terminating short of the rearward end of the slot to provide a space for passage of the bar therethrough, the bar having a side-to-side hole therein for reception of the locking tongue on sliding out of the slide from its forward to its rearward position, the latch for the slide being movable under its bias to its slide-latching position when the slide is pushed in to its forward position, and when in its slide-latching position extending into said space in the slide and being engageable by the tip of the tongue to latch the slide in its forward position to hold the coin in the slide within the body, the latch being pushed back by the bar on insertion of the bar in the first hole and pushing in the bar to release the slide and allow it to move rearward under its bias to its rearward position for entry of the tongue in the hole in the bar for locking the bar in the body and for returning the coin in the slide.

wherein the elongate body of said coin-controlled mechanism is of two-part construction comprising a lower part having an elongate bottom wall, upwardly extending side walls, and a forward end wall and an upper part having an elongate top wall, downwardly extending side walls extending on the side walls of the lower part and an end wall on the end part of the lower wall, the slideway being defined by the bottom wall and the upwardly extending side walls of the lower part and the top wall and the downwardly extending side walls of the upper part, the slide having a sliding fit therein, the first hole being formed partly in the lower side wall and partly in the upper side wall at said one side of the body, the said housing having a lower part on the outside of the lower part of the body and an upper part on the outside of the upper part of the body at the other side, the second hole being formed partly in the lower side wall and partly in the upper side wall at said other side, and further comprising means for detachably securing said parts of the body together, and wherein the slide has a slot at the top extending longitudinally of the slide, the detent having a pin extending down in the slot when the detent is down, the forward end of the slot constitution the first stop and the rearward end of the slot constituting the second stop.

* * * * *